US007717323B2

(12) United States Patent
Kim

(10) Patent No.: US 7,717,323 B2
(45) Date of Patent: May 18, 2010

(54) SHIRT BOX

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 925 days.

(21) Appl. No.: 11/470,149

(22) Filed: Sep. 5, 2006

(65) Prior Publication Data

US 2008/0093257 A1 Apr. 24, 2008

(51) Int. Cl.
*B65D 25/54* (2006.01)
*B65D 43/08* (2006.01)
*B65D 85/18* (2006.01)

(52) U.S. Cl. ..... 229/162.1; 206/278; 206/280; 206/769; 229/125.19

(58) Field of Classification Search ..... 229/162.1, 229/162.6, 164, 125.19; 206/278, 280, 769, 206/770, 771
See application file for complete search history.

(56) References Cited

U.S. PATENT DOCUMENTS 1,000,960 A * 8/1911 Bell ..... 229/125.19
1,786,743 A * 12/1930 Feybusch ..... 229/162.1
1,945,792 A * 2/1934 Stephens ..... 206/769
2,019,870 A * 11/1935 Perry ..... 229/162.1
2,242,741 A * 5/1941 Betts et al. ..... 229/162.1
2,778,487 A * 1/1957 Raeburn ..... 229/162.1
2,989,226 A * 6/1961 Swartz ..... 229/125.19
3,066,792 A * 12/1962 Spilman et al. ..... 206/278
3,176,900 A * 4/1965 Ciganenko ..... 229/125.19
3,178,017 A * 4/1965 Bowman ..... 229/162.1
3,231,077 A * 1/1966 Grimm ..... 229/162.6
3,362,529 A * 1/1968 Gant et al. ..... 206/278
3,380,575 A * 4/1968 Hennessey ..... 206/769
3,392,902 A * 7/1968 Donovan ..... 229/162.1
3,406,816 A * 10/1968 Green et al. ..... 206/769
3,482,680 A * 12/1969 Bixler ..... 229/125.19
3,670,881 A * 6/1972 Dutcher ..... 229/162.1
5,636,746 A * 6/1997 McQueeny ..... 206/769
6,126,068 A * 10/2000 Faircloth et al. ..... 206/770
6,427,907 B1 * 8/2002 Espinoza et al. ..... 229/162.1
6,901,636 B2 6/2005 Kim
6,978,518 B2 12/2005 Kim
7,096,509 B2 8/2006 Kim
7,114,220 B2 10/2006 Kim
2006/0010560 A1 1/2006 Kim

OTHER PUBLICATIONS

U.S. Appl. No. 11/470,930, Kim.
U.S. Appl. No. 11/222,040, Kim.
U.S. Appl. No. 11/435,830, Kim.

* cited by examiner

*Primary Examiner*—Gary E Elkins
(74) *Attorney, Agent, or Firm*—Leason Ellis LLP

(57) ABSTRACT

A shirt box suitable for receiving a shirt includes a base, a box cover and a transparent protective member (insert). The base has a floor and a plurality of upstanding walls that define an interior compartment and the box cover has a top wall and a plurality of walls that surround the top wall (e.g., around a peripheral edge thereof). The top surface has a first opening formed therein that is formed at a location that permits a consumer to see the shirt or other item that is contained within the box. The transparent protective member (insert) has a top surface and a plurality of peripheral walls that surround the top surface (e.g., around a peripheral edge thereof) so as to define a structure that is free standing and independent from both the base and the cover.

20 Claims, 2 Drawing Sheets

50
32
37
35
35
39
36
52
10
70
44
47
30
32
52
34
27
36
54
42
42
40
70
24
46
72
44
26
29
23
60
22
70
47
20
24
26

SHIRT BOX

TECHNICAL FIELD

The present invention relates to retail packaging and in particular, to a shirt box for displaying a shirt so that the consumer can easily view the shirt and have added access to touch a portion of the shirt.

BACKGROUND

In the retail sale of dress shirts and dress shirts and tie combinations, it is desirable to present the merchandise in a manner that permits potential customers to have a good look at the product. On the other hand, it is important for retailers to keep the product clean and free of any soil or stains that may result from handling, to protect against theft, and to maintain the shirts in an orderly and well-folded condition so that their displays remains attractive to passers by.

It is also desirable to have a packaging that addresses the foregoing needs and which permits shirts to be stacked in great number to promote efficient shelf and display space usage.

The present invention satisfies these and other needs.

SUMMARY

A shirt box suitable for receiving a shirt includes a base, a box cover and a transparent protective member (insert). The base has a floor and a plurality of upstanding walls that define an interior compartment and the box cover has a top wall and a plurality of walls that surround the top wall (e.g., around a peripheral edge thereof). The top surface has a first opening formed therein that is formed at a location that permits a consumer to see the shirt or other item that is contained within the box. The transparent protective member (insert) has a top surface and a plurality of peripheral walls that surround the top surface (e.g., around a peripheral edge thereof) so as to define a structure that is free standing and independent from both the base and the cover.

In an assembled state, the protective member is inserted into the interior compartment so that the peripheral walls thereof are supported by the floor of the base and are disposed adjacent the upstanding walls of the base and the cover is mated with the base such that the walls of the cover frictionally seat against the upstanding walls of the base so as to securely hold the cover on the base and retain the protective member within the interior compartment. The opening of the box cover is positioned over a portion of the top surface of the protective member to permit a consumer a clear view of the underlying shirt. However, since the protective member is an independent, free standing structure, a force applied through the first opening and to the protective member does not result in a structural failure or detachment between the protective member and the box cover as is the case in conventional box designs.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
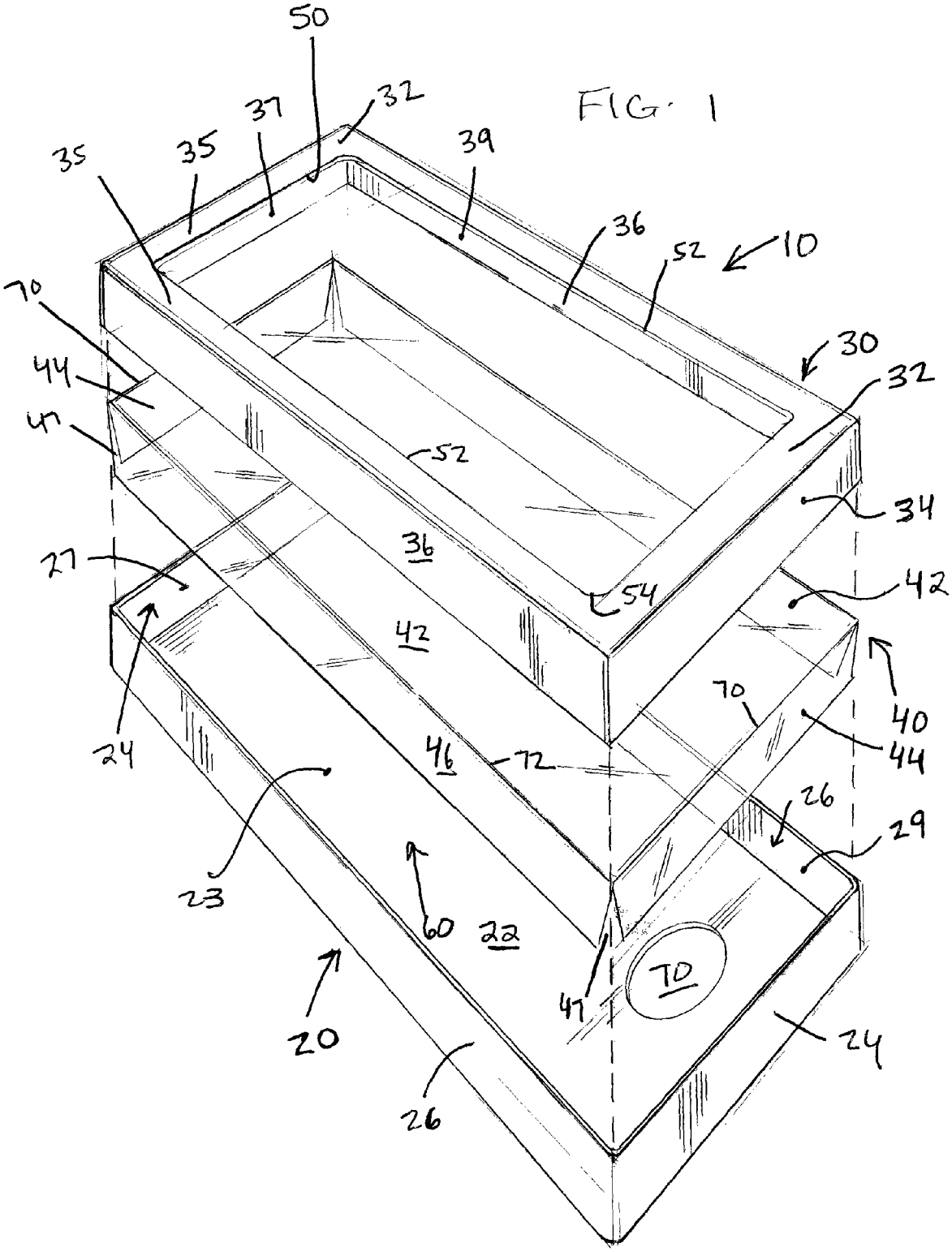
FIG. 1 is an exploded top perspective view of a shirt box according to embodiment of the present invention.

Referring to FIG. 1, a shirt box 10 is formed of a base or bottom box portion 20, a removable box cover 30 that mates with the box portion 20, and an intermediate transparent shirt cover or protector 40 that is received within and is removable from the base 20 and between the box cover 30 and the base 20. While the box 10 can be formed of any number of different materials, including synthetic materials, one exemplary box 10, as illustrated, is formed of a combination of paper material (e.g., reinforced cardboard, etc.) and synthetic material (e.g., a plastic) in the case of the shirt cover 40.

The base or box bottom 20 can be formed to have any number of different shapes, such as a square, oval, circle, triangle, rectangle (as shown), etc. The base 20 is defined by a bottom wall or floor 22 and a plurality of upstanding walls that extend upwardly from the floor 22. In the case of a rectangular shaped base 20, the upstanding walls consist of a pair of opposite end walls 24 and a pair of opposite side walls 26. The end walls 24 and side walls 26 are joined to one another to completely surround the floor 22 and form a bounded structure. The ends walls 24 and side walls 26 preferably are formed at or about at right angles to the floor 22. The floor 22 thus has an inner surface 23 on which a shirt or some other object rests, and an opposite outer surface or face 25 which represents the bottom surface of the entire box 10. The ends walls 24 have corresponding inner surfaces or faces 27 and the side walls 26 have corresponding inner surfaces or faces 29.

The base 10 is preferably formed from paper materials, such as rigid cardboard, and is constructed using conventional box making techniques so as to form a rigid, robust structure.

The box cover 30 includes a top wall or ceiling 32 and a plurality of walls that are arranged around and are integrally attached to the top wall 32 and in the illustrated embodiment, where the box cover 30 has a rectangular shape, the cover 30 includes a pair of opposing end walls 34 and a pair of opposing side walls 36. The end walls 34 and side walls 36 are joined to one another to completely surround the top wall 32 and form a bounded structure. The end walls 34 and side walls 36 preferably are formed at or about at right angles to the top wall 32. The top wall 32 thus has an inner surface 33 (an underside) that faces the floor 22 and an opposite outer surface or face 35 which represents the top surface of the entire box 10. The ends walls 34 have corresponding inner surfaces or faces 37 and the side walls 36 have corresponding inner surfaces or faces 39.

The box cover 30 is preferably formed from paper materials, such as rigid cardboard, and is constructed using conventional box making techniques so as to form a rigid, robust structure.

According to one exemplary embodiment of the present invention, the box cover 30 and more particularly, the top wall 32 thereof, includes an opening, window or cutout 50 formed therein to permit the item (e.g., shirt) contained in the box base 20 to be easily viewed. The formation of the opening 50 defines a peripheral edge 52 that defines the boundaries of the opening 50. It will be appreciated that the location, size and shape of the opening 50 can be varied and can be chosen from a great number of different sizes and shapes so long as a substantial portion of the object (shirt) in the base 20 can be easily viewed through the opening 50.

In the illustrated embodiment, the opening 50 has a rectangular shape and is centrally located within the top wall 32 so as to define top border portions represent portions of the top wall 32 that are formed around the opening 50. In other words, the opening 50 is preferably formed at a location such that the distance between the top edges of the opening 50 and wall 32 and the bottom edges of the opening 50 and wall 32 is about equal and the distance between the side edges of the opening 50 and the wall 32 is about equal. The illustrated opening 50 has rounded corners 54 to give a smoother, flowing appearance.

The mating of box cover 30 to the base 20 is similar to standard box design in that the end walls 32 and side walls 34 of the box cover 30 are received over the corresponding end walls 22 and side walls 24 of the base 20. The distance between the opposing side walls and end walls in each structure are thus selected so that a snug fit results between the box cover 30 and the base 20 when the box cover 30 is mated to the base 20. As shown in the Figures, the top wall 32 of the cover 30 extends inwardly from the end and side walls 22, 24 of the base 20 so as to conceal the end and side walls 22, 24 and thus, position the opening 50 over the floor 22 of the base to permit clear viewing of the object (shirt). The sections of the top wall 32 around the opening 40 are in the form of flange-like sections of the box cover 30 that extend inwardly over a cavity or compartment 60 that is defined in the base 20 for receiving the shirt.

In contrast to conventional box designs where any transparent window portion is in the form of a flat sheet of transparent plastic that is adhered to an underside of wall sections formed around an opening formed in the box cover, the transparent portion of the box 10 of the present invention is in the form of a member that is separate and independent from both the base 10 and the box cover 30, and in particular, the transparent window section of the box 10 is provided by the shirt protector or cover 40.

The shirt cover 40 is a self-supporting, free standing, upstanding structure that is received within the compartment 60 and stands upright therein around the shirt or other object that is resting on the floor 22 of the base 20. The shirt cover 40 is defined by a top wall or panel 42 and a number of upstanding walls and more particularly, the shirt cover 40 has a pair of opposing end panels 44 and a pair of opposing side panels 46. The shirt cover 40 is transparent or semi-transparent in nature and is typically formed of a plastic material and in particular, can be manufactured as a substrate that is folded along fold lines to form a folded structure. For example, the shirt cover can have a pair of end fold lines 70 that are formed between the top panel 42 and each of the end panels 44 and a pair of side fold lines 72 that are formed between the top panel 42 and each of the side panels 46. The fold lines 70 are parallel to one another and the fold lines 72 are parallel to one another, with the fold lines 70 being perpendicular to the fold lines 72 and vice versa.

To form the upstanding, free standing structure 40, the side panels 46 are folded along the fold lines 72 and the end panels 44 are folded along the fold lines 70. It will therefore be appreciated that the individual end panels 44 are not directly attached to the side panels 46 and vice versa but instead, slots 47 are formed between adjacent panels. The slots 47 permit each panel 44, 46 to have a degree of freedom or movement or flexing to permit the end panels 44 and side panels 46 to flex and be received within the adjacent and complementary end walls 24 and side walls 26.

The height of the shirt cover 40 is selected such that when the shirt cover 40 is placed in the compartment 60 on the floor 22, the top panel 42 is generally in the same plane as the top edges of the end panels 24 and side panels 26 of the base 20. When the shirt cover 40 is in its self supported, freely upstanding position, the distance from the top panel 42 to floor 22 is sufficient to permit the shirt or other object to be received therein such that when the shirt (object) sits on the floor 22, the top of the shirt is close to or even in slight contact with the top panel 42 of the shirt cover 40. The transparent or even semi-transparent nature of the protective shirt cover 40 permits the consumer to easily view the contents (e.g., a shirt) contained in the compartment 60 without manipulation of the box 10 and more particularly, without any manipulation of the box cover 30.

Since the protective shirt cover 40 is totally independent from the base 20 and the box cover 30, it can be easily removed from the base 20 to permit reception of the shirt on the floor 22 of the base 20. In addition, since the shirt cover 40 is totally independent from the box cover 30, the box cover 30 can easily be removed from the base 20 without worrying about the integrity of the transparent window portion of the box 10, in this case, the protective shirt cover 40.

By folding the end panels 44 and side panels 46 about the fold lines 70, 72, a free standing, self-supported, upright structure is formed that can stand on the floor 22 without collapsing or otherwise deform due in part to the presence of the walls 24, 26 which serve to restrict any outward movement of the end panels 44 and the side panels 46 and retain the generally rectangular shape of the protective shirt cover 40.

The width of the top panel 42 is therefore about equal to or slightly less than the distance between the side walls 26 of the base 20 to permit reception of the protective shirt cover 40 into the compartment 60. The dimensions of the end panels 44 and side panels 46 are therefore complementary to the corresponding walls 24, 26 of the base 20 so that when the protective shirt cover 40 is received in the compartment 60, the protective shirt cover 40 at least substantially occupies the area of the compartment 60.

Figure 2:
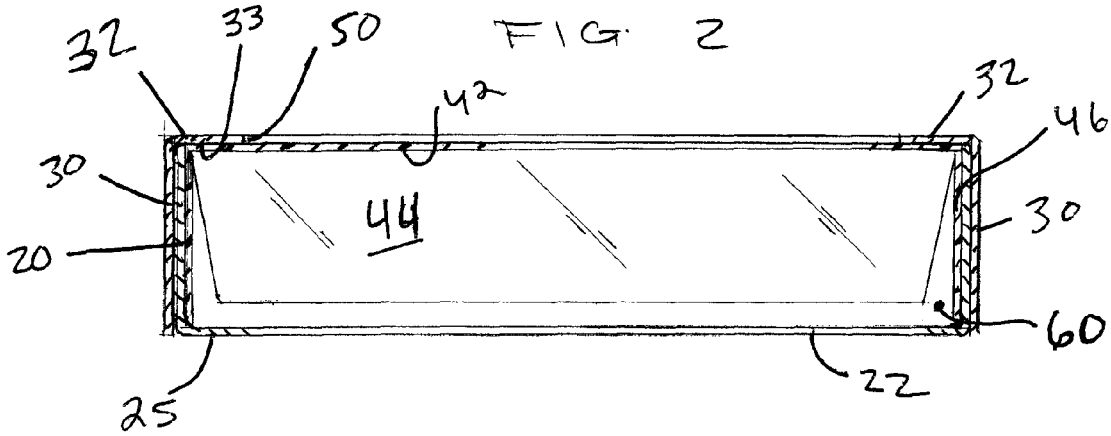
FIG. 2 is a cross-sectional view of the shirt box of FIG. 1 in a fully assembled state.

FIG. 2 is a cross-sectional view of the box 10 in an assembled condition where the protective shirt cover 40 is inserted into the compartment 60 of the base 10, where it remains as an independent, free-standing structure, and then the box cover 30 is inserted over the base 20 and the protective shirt cover 40 so that an underside of the top wall 32 of the box cover 30 seats against the top surface of the top panel 42 of the protective shirt cover 40. In this position, there is an appearance that the protective shirt cover 40 and the box cover 30 are an integral single structure since when the consumer views the top of the box cover 30, the underlying protective shirt cover 40 extends across and occupies the entire window/opening 50 and since the box cover 30 is securely held on the base 20, the flange-like structure of the top wall 32 of the box cover 30 serves to apply a force to the protective shirt cover 40 and prevent it from upward movement out of the compartment 60. In this manner, the protective shirt cover 40 is securely held in place and the appearance of the protective shirt cover 40 relative to the box cover 30 is one of a taut nature.

It will be appreciated and as illustrated, at least the opposing side panels 46 seat against the floor 22 of the base 20; however, the shorter end panels 44 do not necessarily have to seat against the floor 22 and as shown in FIG. 2, the end panels 44 can have a height that is slightly less than the height of the side panels 46 and therefore, the end panels 44 do not seat against the floor 22. However, even in this embodiment, the height of the end panel 44 is selected so that the end panel 44 extends a substantial length of the end wall 24 of the base 20 as illustrated. The longer side panels 46 extend completely to the floor 22.

However, it will be appreciated that the end panels 44 can be formed so that they extend completely to the floor 22 in the same manner as the side panels 46.

As mentioned earlier, one of the disadvantages to having a protective plastic sheet directly attached to the underside of the box cover is that this type of arrangement is much more prone to fracture since a force applied directly to the top of the plastic sheet in the area of the window can easily cause a local dislodgment of the plastic sheet from the underside of the box cover. Not only does this create an unsightly appearance since the tautness of the plastic sheet is lost but it also jeopardizes the integrity of the object (e.g., a shirt) that is contained within the box since a person could easily insert a finger or other object into the area of dislodgment and come into direct contact with the object. In the case of a shirt contained in the compartment, the shirt could become soiled by such contact.

Preferably and as shown in the FIG. 1, the shirt box 10 is formed with an opening 70 in one of the surfaces (e.g., the floor 22) that forms the box. Opening 70 is positioned such that the outline of the hole overlies a portion of the article, such as a shirt, that is contained in the box 10. This arrangement provides access to the garments inside the shirt box 10 so that consumers can touch and feel the garments yet does not compromise the structural integrity of the box 10, especially, the integrity of the transparent protective shirt cover 40.

Figure 3:
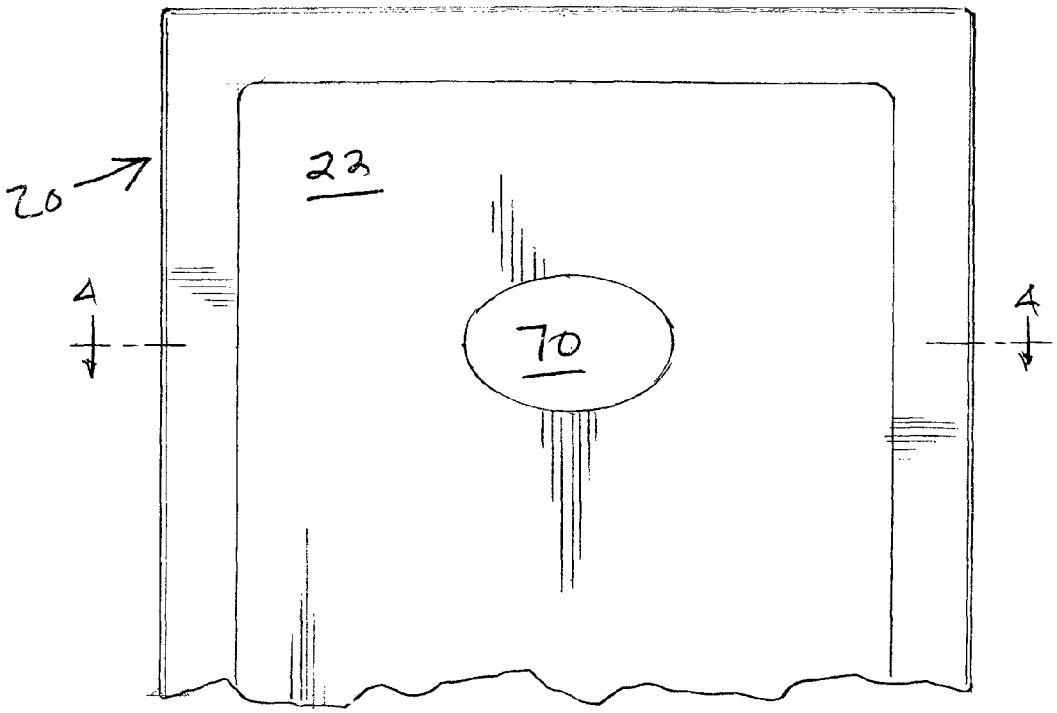
FIG. 3 is a partial rear plan view of the shirt box of FIG. 1 with a box cover being moved to a rear position.
Figure 4:
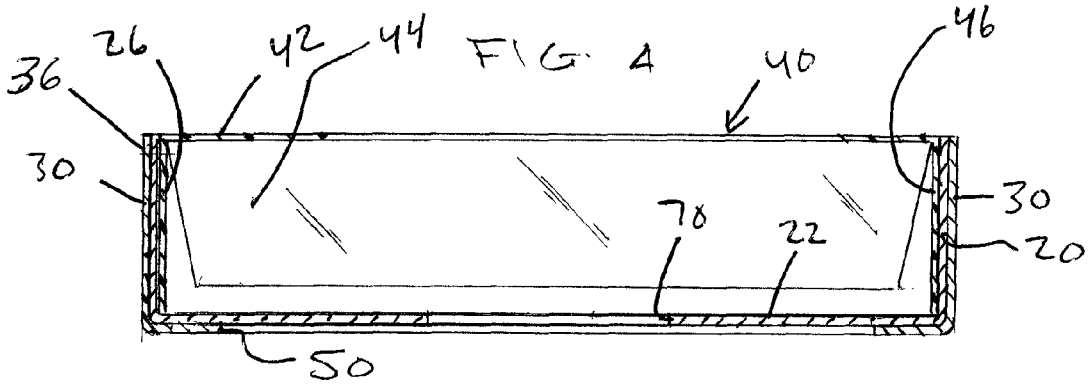
FIG. 4 is cross-sectional taken along the line 4-4 of FIG. 3.

FIGS. 3 and 4 illustrate a second position of the components of the box 20 and more specifically, the box cover 30 has been removed from its position where it is inserted over the base 20 and instead, is placed on an underside or bottom of the base 20. In other words, the box cover 30 is removed and lifted off the base 20 so as to expose the protective shirt cover 40 and then is inverted and mated with the base 20 by receiving the base 20 within an interior space 31 that is defined by the end walls 32 and side walls 34 of the box cover 30. In this manner, the base 20 is received within the box cover 30 so that the end and side walls 34, 36 of the box cover 30 are received over and exterior to the corresponding end and side walls 24, 26 of the base 20 as is shown in FIG. 4. Once again, even in this arrangement, the top panel 42 of the protective shirt cover 40 lies generally in the same plane as the top edges of the upstanding walls of both the base 20 and the box cover 30.

It will be appreciated that even in this second position when the box cover 30 is inverted and mated with the bottom of the base 20, the opening 70 is still accessible and the article in the box can be touched since the opening or window 50 is in registration with the opening 70 and the window 50 is free of any transparent, protective plastic sheet since, according to the present invention, the protective shirt cover 40 is completely separate from the box cover 30. The ability to access the opening 70 would not be possible with conventional box design where the window of the box cover is formed by adhering a transparent plastic sheet around a cutout formed in the box cover since the plastic sheet is permanently attached across the cutout and therefore, it would prevent a person from accessing the opening 70 in the floor 22 if the box cover was placed in the second position shown in FIGS. 3 and 4.

It will also be appreciated that the arrangement of the protective shirt cover 40 relative to the box cover 30 in the box 10 of the present invention provides improved stacking capability since the stacking of boxes applies a force, due its weight, to the underlying box and therefore, in the standard box cover design, in which the transparent plastic sheet is attached directly the box cover, the weight of one box can puncture and locally separate the plastic sheet from its point of attachment to the shirt box since the mass of the top box can not be borne by thin plastic sheet that is only attached along its peripheral edges to the underside of the box cover. Not only does this damage the integrity of the box but it also blemishes the appearance of the box. In contrast, since the protective shirt cover 40 is a separate, self-supported, upstanding structure, relative to the box cover 30, the shirt cover 40 is able to better support the weight of the top stacked box, which is also supported by the flange sections of the box cover 30. Since there is no direct attachment between the protective shirt cover 40 and the box cover 30, the weight of the top stacked box cannot cause detachment of the protective shirt cover from the box cover. Instead, the self-supporting, free standing protective shirt cover 40 offers improved weight bearing capabilities.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A shirt box suitable for receiving a shirt, comprising:

a base having a floor and a plurality of upstanding walls that define an interior compartment;

a cover having a top wall and a plurality of walls that surround the top wall, wherein the top surface has a first opening formed therein; and a transparent protective member that has a top surface and a plurality of peripheral walls that surround the top surface so as to define a structure that is free standing and independent from both the base and the cover;

wherein in an assembled state, the protective member is inserted into the interior compartment so that the first opening is positioned over a portion of the top surface of the protective member to permit a clear view of the underlying shirt, the peripheral walls of the protective member being supported by the floor of the base and being disposed adjacent the upstanding walls of the base and wherein the cover is mated with the base such that the walls of the cover frictionally seat against the upstanding walls of the base so as to securely hold the cover on the base and retain the protective member within the interior compartment.

2. The shirt box of claim 1, wherein the upstanding walls extend perpendicularly up from the floor of the base and are integrally attached to one another.

3. The shirt box of claim 1, wherein the walls of the cover extend perpendicularly from the top surface.

4. The shirt box of claim 1, wherein the formation of the opening in the top wall creates a plurality of flange sections that are formed peripherally around the opening, wherein in the assembled position, the flange sections are disposed over peripheral edges of the top surface of the protective member.

5. The shirt box of claim 1, wherein the first opening occupies greater than 75% of the area of the top wall of the cover.

6. The shirt box of claim 1, wherein the protective member is formed of a flexible plastic sheet.

7. The shirt box of claim 1, wherein the peripheral panels of the protective member are joined to the top surface about first and second sets of fold lines to permit the peripheral panels to be folded so that they are substantially perpendicular relative to the top surface.

8. The shirt box of claim 1, wherein each of the peripheral walls are separated from adjacent peripheral walls by means of slots formed in the protective member.

9. The shirt box of claim 7, wherein the first set of fold lines defines side panels of the protective member and is parallel to one another, the second set of fold lines defining end panels of the protective member, the second set of fold lines being parallel to one another and perpendicular to the first set of fold lines.

10. The shirt box of claim 1, wherein a height of the protective member when the peripheral panels are folded to form the free standing structure as measured from the top surface to a bottom of the folded peripheral panels is about equal to a distance from the floor to a top edge of the walls of the base.

11. The shirt box of claim 1, wherein the top surface of the protective member is sized so as to at enclose approximately the entire interior compartment when it is inserted therein.

12. The shirt box of claim 1, wherein the top surface of the protective member is free of any attachment to the box cover.

13. The shirt box of claim 1, wherein the top surface of the protective member seats against an underside of a plurality of flange sections that are formed peripherally around the opening in the top wall of the cover, wherein in the assembled position, the flange sections are disposed over peripheral edges of the top surface of the protective member.

14. The shirt box of claim 1, wherein when the cover is mated with the base, the walls of the cover are disposed against exterior surfaces of the upstanding walls of the base.

15. The shirt box of claim 1, wherein the protective member in its free standing form defines substantially enclosed interior cavity that receives the shirt that sits on the floor of the base.

16. The shirt box of claim 1, wherein the protective member is formed of a flexible plastic sheet such that when inserted into the interior compartment, the peripheral panels flex outwardly against the upstanding walls of the base.

17. The shirt box of claim 1, further including a second opening formed in the floor of the base so as to permit the shirt disposed in the interior compartment to be touched.

18. The shirt box of claim 17, wherein in a second position where the box cover is inverted and the base is disposed in an inner cavity defined by the walls of the cover, the first and second openings are in registration with one another to permit a person to still be able to access and touch the shirt when the cover is placed in this inverted position.

19. A shirt box suitable for receiving a shirt, comprising:

a base having a floor and a plurality of upstanding walls integral with the floor that define an interior compartment;

a cover having a top wall and a plurality of walls that are integrally attached to the top wall around a periphery thereof, wherein the top surface has a first opening formed therein; and a transparent flexible plastic protective insert that has a top surface and a plurality of foldable panels that are attached to the top surface along fold line, wherein when the insert is disposed within the interior compartment for covering the shirt, the panels are folded about the fold lines to form a free standing structure that is independent and free of attachment to both the base and the cover, the free standing structure being supported by the floor of the base, with the folded panels being disposed adjacent the upstanding walls of the base;

wherein the cover is mated with the base such that the walls of the cover frictionally seat against the upstanding walls of the base so as to securely hold the cover on the base and retain the protective member within the interior compartment.

20. A shirt and box combination comprising:

a shirt;

a box including:

a base having a floor and a plurality of upstanding walls integral with the floor that define an interior compartment that receives the shirt;

a cover having a top wall and a plurality of walls that are integrally attached to the top wall around a periphery thereof, wherein the top surface has a first opening formed therein; and a transparent flexible plastic protective insert that has a top surface and a plurality of foldable panels that are attached to the top surface along fold line, wherein when the insert is disposed within the interior compartment for covering the shirt, the panels are folded about the fold lines to form a free standing structure that is independent and free of attachment to both the base and the cover, the free standing structure being supported by the floor of the base, with the folded panels being disposed adjacent the upstanding walls of the base;

wherein the cover is mated with the base such that the walls of the cover frictionally seat against the upstanding walls of the base so as to securely hold the cover on the base and retain the protective member within the interior compartment.

* * * * *